US009574451B2

(12) United States Patent
Wang et al.

(10) Patent No.: US 9,574,451 B2
(45) **Date of Patent: *Feb. 21, 2017**

(54) NI-BASED SUPERALLOY, AND TURBINE ROTOR AND STATOR BLADES FOR GAS TURBINE USING THE SAME

(71) Applicant: Mitsubishi Hitachi Power Systems, Ltd., Yokohama-shi, Kanagawa (JP)

(72) Inventors: Yuting Wang, Hitachi (JP); Akira Yoshinari, Hitachinaka (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/687,535

(22) Filed: Apr. 15, 2015

(65) Prior Publication Data

US 2015/0218952 A1 Aug. 6, 2015

Related U.S. Application Data

(63) Continuation of application No. 13/335,020, filed on Dec. 22, 2011, now Pat. No. 9,034,248.

(30) Foreign Application Priority Data

Dec. 28, 2010 (JP) ..... 2010-293142

(51) Int. Cl.
*C22C 19/05* (2006.01)
*F01D 5/28* (2006.01)
(Continued)

(52) U.S. Cl.
CPC ..... *F01D 5/28* (2013.01); *C22C 1/023* (2013.01); *C22C 19/056* (2013.01); *C22F 1/10* (2013.01); *F05D 2300/175* (2013.01)

(58) Field of Classification Search
CPC combination set(s) only.
See application file for complete search history.

(56) References Cited

U.S. PATENT DOCUMENTS 3,619,182 A 11/1971 Bieber
4,895,201 A 1/1990 DeCrescente et al.
(Continued)

FOREIGN PATENT DOCUMENTS

CN 1914339 A 2/2007
CN 101899594 A 12/2010
(Continued)

OTHER PUBLICATIONS

JP Office Action of Application No. 2010-293142 dated Mar. 12, 2013.
(Continued)

*Primary Examiner* — Jessee Roe
(74) *Attorney, Agent, or Firm* — Crowell & Moring LLP

(57) ABSTRACT

An object of the present invention is to provide a Ni-based superalloy, especially for a conventional casting, having a good balance among high temperature strength, corrosion resistance and oxidation resistance, as compared to a conventional material. The Ni-based superalloy comprises Cr, Co, Al, Ti, Ta, W, Mo, Nb, C, B, and inevitable impurities, the balance being Ni, the Ni-based superalloy having a superalloy composition comprising, by mass, 13.1 to 16.0% Cr, 11.1 to 20.0% Co, 2.30 to 3.30% Al, 4.55 to 6.00% Ti, 2.50 to 3.50% Ta, 4.00 to 5.50% W, 0.10 to 1.20% Mo, 0.10 to 0.90% Nb, 0.05 to 0.20% C, and 0.005 to 0.02% B.

13 Claims, 4 Drawing Sheets

(51) Int. Cl.
*C22C 1/02* (2006.01)
*C22F 1/10* (2006.01)

(56) References Cited

U.S. PATENT DOCUMENTS

| | | | | |
|---|---|---|---|---|
| 5,043,138 | A | 8/1991 | Darolia et al. | |
| 5,374,319 | A | 12/1994 | Stueber et al. | |
| 5,476,555 | A | 12/1995 | Erickson | |
| 6,416,596 | B1 | 7/2002 | Wood et al. | |
| 6,818,077 | B2 | 11/2004 | Yoshinari et al. | |
| 7,169,241 | B2 | 1/2007 | Tamaki et al. | |
| 9,034,248 | B2 * | 5/2015 | Wang et al. | 420/448 |
| 2004/0221925 | A1 | 11/2004 | Tamaki et al. | |
| 2005/0047953 | A1 | 3/2005 | Hieber et al. | |
| 2005/0047954 | A1 | 3/2005 | Hieber et al. | |
| 2006/0113009 | A1 | 6/2006 | Burgel | |
| 2010/0080730 | A1 | 4/2010 | Yoshinari | |
| 2010/0303665 | A1 | 12/2010 | Bain et al. | |
| 2010/0329883 | A1 | 12/2010 | Mourer | |
| 2011/0203707 | A1 | 8/2011 | Mourer et al. | |

FOREIGN PATENT DOCUMENTS

| | | | |
|---|---|---|---|
| DE | 23 33 775 | | 1/1975 |
| EP | 0 709 477 | A1 | 5/1996 |
| EP | 1 193 321 | A1 | 4/2002 |
| EP | 1 801 263 | A1 | 6/2007 |
| GB | 223452 | | 10/1924 |
| GB | 2 105 748 | * | 3/1983 |
| JP | 51-34819 | | 3/1976 |
| JP | 9-170402 | | 6/1997 |
| JP | 2004-197131 | | 7/2004 |
| JP | 2004-332061 | | 11/2004 |
| JP | 2010-84166 | | 4/2010 |
| WO | WO 01/09403 | A1 | 2/2001 |

OTHER PUBLICATIONS

Office Action from State Intellectual Property Office of the People's Republic of China (SIPO) of Application No. 201110442776.5 dated Sep. 11, 2013 with partial English translation.
EP Notice of Opposition of Application No. 11195397.2 dated Oct. 4, 2013 with partial English Translation.
JP Office Action of Application No. 2010-293142 dated Mar. 12, 2013
EP Search Report of Application No. 11195397.2 dated Apr. 5, 2012 in English.
Office Action from the State Intellectual Property Office of the People's Republic of China (SIPO) of Application No. 201119442776.5 dated Sep. 11, 2013 with partial English translation.

* cited by examiner

NI-BASED SUPERALLOY, AND TURBINE ROTOR AND STATOR BLADES FOR GAS TURBINE USING THE SAME

CROSS REFERENCE TO RELATED APPLICATIONS

This application is a continuation of U.S. application Ser. No. 13/335,020, now U.S. Pat. No. 9,034,248, filed Dec. 22, 2011, which claims priority from Japanese Patent Application No. 2010-293142 filed on Dec. 28, 2010, the disclosures of which are expressly incorporated by reference herein.

BACKGROUND OF THE INVENTION

Field of the Invention

The present invention relates to a Ni-based superalloy, and a cast product and gas turbine rotor and stator blades using the Ni-based superalloy.

Background Art

Recently, an increase in thermal efficiency in an internal combustion engine has been tried, from the viewpoint of growing environmental consciousness such as the saving of fossil fuels, reduction in carbon dioxide emissions and prevention of global warming. It is known that a thermal efficiency can be most effectively enhanced by operating a high temperature side of Carnot cycle at a higher temperature in a thermal engine such as a gas turbine and a jet engine. In accordance with a higher turbine inlet temperature, an importance of an improvement and development of materials used as hot parts of a gas turbine, i.e., a combustor or turbine rotor and stator blades, is enhanced. In order to deal with such a higher turbine inlet temperature, a Ni-based heat resistant superalloy having a better high-temperature strength is applied as a material, and many Ni-based superalloys are used at present. Examples of the Ni-based superalloy include a conventional casting superalloy having an isometric crystal, a directionally solidified superalloy having a columnar crystal, and a monocrystal superalloy having one crystal. In order to enhance the strength of the Ni-based superalloy, it is important to add Al and Ti and the like to precipitate many $\gamma'Ni_3(Al, Ti)$ phase, which is a reinforcing phase, together with adding many amounts of a solid-solution reinforcing element such as W, Mo, Ta and Co.

In the meantime, due to an elevated fuel price, a low quality fuel containing a large amount of impurities causing a corrosion starts to be used as a fuel for an industrial gas turbine, and it is also necessary to develop a material having both high-temperature strength and corrosion resistance. In such a material, it is desirable that a large amount of Cr forming a protective coating film be added. Examples of a superalloy, which gives weight to corrosion resistance, include conventional casting superalloys which are disclosed in, for example, JP Patent Publication (Kokai) No. 2004-197131 A, JP Patent Publication (Kokai) No. 51-34819 A (1976) and JP Patent Publication (Kokai) No. 2010-84166 A.

However, problem of such a superalloy are: when many amounts of elements added are contained, the stability of the constitution of a material is further lowered and a hard and brittle harmful phase such as a 6 phase is precipitated during a long period time of use. That is, it is difficult to develop a superalloy material having a good high-temperature creep strength and simultaneously corrosion resistance and oxidation resistance.

SUMMARY OF THE INVENTION

Thus, an object of the present invention is to provide a Ni-based superalloy, especially for a conventional casting, having a good balance among high-temperature strength, corrosion resistance and oxidation resistance, as compared to a conventional material. Another object of the present invention is to provide a cast product and turbine rotor and stator blades using the Ni-based superalloy.

In order to solve the above problems, the present invention uses, for example, a constitution described in the claims. The present invention includes a plurality of means for solving the problems, but one example thereof is a Ni-based superalloy comprising Cr, Co, Al, Ti, Ta, W, Mo, Nb, C, B, and inevitable impurities, the balance being Ni, the Ni-based superalloy having a superalloy composition comprising, by mass, 13.1 to 16.0% Cr, 11.1 to 20.0% Co, 2.30 to 3.30% Al, 4.55 to 6.00% Ti, 2.50 to 3.50% Ta, 4.00 to 5.50% W, 0.10 to 1.20% Mo, 0.10 to 0.90% Nb, 0.05 to 0.20% C, and 0.005 to 0.02% B.

The present invention provides a Ni-based superalloy, for a conventional casting, having a good balance among characteristics such as high-temperature strength, corrosion resistance and oxidation resistance, as compared to a conventional material. Additionally, the superalloy of the present invention contains C and B, which are effective for reinforcement of a grain boundary, and Hf, which is effective for inhibition of grain boundary cracking during casting, and thus the superalloy of the present invention has a superalloy composition suitable for use as a directionally solidifying material. Problems, constitutions and advantageous effects other than above ones are clarified by explaining the following embodiments.

DETAILED DESCRIPTION OF THE PREFERRED EMBODIMENTS

The present invention is explained in detail as follows.

Figure 4:
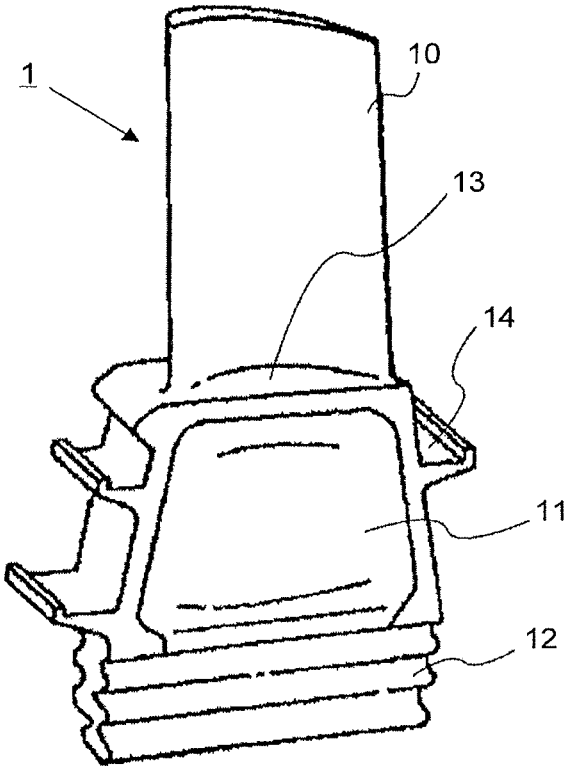
FIG. 4 is a diagram showing one example of a rotor blade shape of a gas turbine.

First, FIG. 4 shows one example of a turbine rotor blade of an industrial gas turbine. This turbine rotor blade 1 is constituted of a blade part 10, a shank part 11, and a root part (dovetail part) 12, and has a size of 10 to 100 cm and a weight of about 1 to 10 kg. Additionally, the turbine rotor blade 1 is equipped with a platform part 13 and a radial fin 14. The turbine rotor blade is a rotating part having a complicated cooling structure inside thereof, and is exposed to severe environments in which a load of a thermal stress due to a start-stop and a centrifugal force during rotation is repeatedly applied. As basic material characteristics, a good high-temperature creep strength and oxidation resistance and corrosion resistance to a high-temperature combustion gas atmosphere are required. In the meantime, the turbine stator blade usually has a vane extending along a wing axis, and at a tail end side of the vane, a base is integrally formed which extends perpendicular to the wing axis for fixing the turbine blade to each supporting medium. A material for the turbine stator blade requires a good high-temperature strength and thermal fatigue strength. Therefore, development of a superalloy for casting having a good balance among these characteristics is regarded as important. The present inventors studied a superalloy for a conventional casting which can maintain creep strength and simultaneously have an improved corrosion resistance and oxidation resistance, and as a result, the present inventors found the present invention mentioned above.

Examples of a production means for a general gas turbine blade include means by a conventional casting method, a directional solidification casting method and a single crystal casting method. A directionally solidified superalloy or a monocrystal superalloy are mainly used for a rotor blade of a small size and light-weight jet engine (an aircraft gas turbine). However, a blade using a directionally solidified superalloy or a monocrystal superalloy is complicated in casting process, and thus casting yield becomes low at the time of casting the blade. Especially, problems are: a blade of an industrial gas turbine is large in size and complicated in shape, and thus casting yield becomes low, leading to an expensive product.

Thus, the present inventors studied a superalloy having an improved balance among respective characteristics such as high-temperature strength, corrosion resistance, and oxidation resistance, as compared to conventional materials, as especially a superalloy for conventional casting, having balanced superalloy elements added. Actions of respective components contained in the Ni-based superalloy of the present invention and a preferred composition range thereof are explained below.

Cr: 13.1 to 16.0% by Mass

Cr is an element which is effective for improving the corrosion resistance of a superalloy at high temperatures, and especially in order to improve corrosion resistance to molten salt corrosion, a higher content of Cr makes the effect larger. When the content exceeds 13.1% by mass, the effect remarkably appears. However, many amounts of Ti, W, Ta and the like are added in the superalloy of the present invention, and thus when the amount of Cr is too large, a brittle TCP phase is precipitated and high-temperature strength is lowered. Therefore, in view of a balance with other superalloy elements, it is desirable that the upper limit be 16.0% by mass. In such a composition range, a high strength and a good corrosion resistance are obtained. The range is preferably 13.1 to 14.3% by mass, more preferably 13.7 to 14.1% by mass.

Co: 11.1 to 20.0% by Mass

Co has effects of lowering a solvus temperature of a γ' phase (an intermetallic compound $Ni_3Al$ of Ni and Al) to make a solution treatment easy, solid-solution reinforcing a γ phase and improving high-temperature corrosion resistance, and further has the effect of making a stacking fault energy small to make room-temperature ductility good. When the content of Co is 11.1% by mass or more, such effects appear. In the meantime, when the content of Co is increased, the solvus temperature of the γ' phase is gradually lowered, and together the amount of the γ' phase precipitated is decreased and creep strength is lowered, and thus the content of Co is necessary to be 20.0% by mass or less.

In the case of especially giving weight to room-temperature ductility and creep strength at a medium temperature region, which exhibits a large Co-induced solid-solution reinforcing effect, in the composition range of the present invention, the content of Co is in the range of preferably 11.1 to 18.0% by mass, more preferably 14.1 to 17.0% by mass.

W: 4.00 to 5.50% by Mass

W intercrystallizes with a γ phase, which is a matrix, and a γ' phase, which is a precipitated phase, and has an enhancing effect on creep strength by a solid-solution reinforcement. In order to sufficiently obtain such an effect, a content of 4.00% by mass or more is necessary. However, W has a high specific gravity, increases a density of a superalloy, and lowers the corrosion resistance of a superalloy at high temperatures. Additionally, in a superalloy containing large amounts of Ti and Cr added as in the superalloy of the present invention, when the content of W exceeds 5.50% by mass, a needle-shaped α-W is precipitated to lower creep strength, high-temperature corrosion resistance and toughness; and thus it is desirable that the upper limit of the content of W be 5.50% by mass. Additionally, in view of a balance among corrosion resistance and strength at high temperatures and structural stability at high temperatures, the content of W is in the range of preferably 4.55 to 4.90% by mass, more preferably 4.55 to 4.85% by mass.

Ta: 2.50 to 3.50% by Mass

Ta is an element intercrystallizing with a γ' phase in the form of [$Ni_3$(Al, Ta)] and having an enhancing effect on creep strength by a solid-solution reinforcement. In order to sufficiently obtain such an effect, a content of 2.50% by mass or more is necessary. When the content of Ta exceeds 3.50% by mass, a supersaturation is generated to precipitate a needle-shaped δ phase [Ni, Ta] to lower creep strength. Thus, it is necessary that the upper limit of the content of Ta be 3.50% by mass. In view of a balance among a structural stability and strength at high temperatures in the composition range, the content of Ta is in the range of preferably 2.70 to 3.30% by mass, more preferably 2.90 to 3.20% by mass.

Mo: 0.10 to 1.20% by Mass

Mo has effects similar to those of W, and thus can be substituted for a part of W according to need. Additionally, Mo elevates a solvus temperature of the γ' phase, and thus Mo has an enhancing effect on creep strength as W has. In order to obtain such effects, a content of 0.10% by mass or more is necessary, and an increased content of Mo enhances creep strength. Additionally, Mo has a specific gravity lower than that of W, and thus a light-weight superalloy can be achieved.

In the meantime, Mo lowers the oxidation resistance characteristics and the corrosion resistance of the superalloy. Especially, an increased content of Mo remarkably reduces oxidation resistance characteristics, and thus it is necessary that the upper limit of the content of Mo be 1.20% by mass. In the case of giving weight to oxidation resistance characteristics at high temperatures and corrosion resistance together with a creep strength approximately equal to that of a conventional superalloy, in the composition range of the present invention, the content of Mo is in the range of preferably 0.10 to 1.10% by mass, more preferably 0.70 to 1.00% by mass.

Ti: 4.55 to 6.00% by Mass

Ti intercrystallizes with a γ' phase in the form of [$Ni_3$(Al, Ta, Ti)] as well as in Ta, but Ti does not have an effect as in Ta regarding a solid-solution reinforcement. Ti has a remarkably improving effect on the corrosion resistance of a superalloy at high temperatures rather than that. In order to obtain a remarkable effect on corrosion resistance to molten salt corrosion, a content of 4.55% by mass or more is necessary. However, when more than 6.00% by mass of Ti is added, oxidation resistance characteristics are remarkably deteriorated and further a η phase, which is a brittle phase, is precipitated. Additionally, when the amount of Ti added, which is an element forming the γ' phase, is increased, the amount of the γ' phase precipitated is also increased. Therefore, it is necessary that the upper limit of the content of Ti be 6.00% by mass. In view of a balance among corrosion resistance and oxidation resistance characteristics and strength at high temperatures in a superalloy containing 13.1 to 16.0% by mass of Cr as in the superalloy of the present invention, the content of Ti is in the range of preferably 4.65 to 5.50% by mass, more preferably 4.70 to 5.10% by mass.

Al: 2.30 to 3.30% by Mass

Al is a main element which constitutes a γ' phase [$Ni_3Al$] which is a precipitation strengthening phase, and thus creep strength is enhanced. Additionally, Al greatly contributes to an enhancement of oxidation resistance characteristics at high temperatures. In order to sufficiently obtain these effects, a content of 2.30% by mass or more is necessary. Contents of Cr, Ti and Ta are high in the superalloy of the present invention, and thus when the content of Al exceeds 3.30% by mass, a γ' phase [$Ni_3$(Al, Ta, Ti)] is over-precipitated to lower strength on the contrary and a complex oxide with Cr is formed to lower corrosion resistance; and thus it is desirable that the content of Al be 2.30 to 3.30% by mass. In view of a balance among oxidation resistance characteristics and corrosion resistance and strength at high temperatures in the composition range, the content of Al is in the range of preferably 2.60 to 3.30% by mass, more preferably 3.00 to 3.20% by mass.

Nb: 0.10 to 0.90% by Mass

Nb intercrystallizes with a γ' phase in the form of [$Ni_3$(Al, Nb, Ti)] as well as in Ti, and has a larger solid-solution reinforcement effect than Ti. Additionally, Nb has an improving effect on corrosion resistance at high temperatures although not as remarkable as that of Ti. In order to obtain a solid-solution reinforcement effect at high temperatures due to an addition thereof, a content of is 0.10% by mass or more is necessary. However, in a superalloy containing a large amount of Ti as in the superalloy of the present invention, when the content of Nb exceeds 0.90% by mass, a η phase, which is a brittle phase, is precipitated and strength is remarkably lowered, and thus it is necessary that the upper limit of the content of Nb be 0.90% by mass. In view of a balance among corrosion resistance and oxidation resistance characteristics and strength at high temperatures, the content of Nb is in the range of preferably 0.10 to 0.65% by mass, more preferably 0.25 to 0.45% by mass.

C: 0.05 to 0.20% by Mass

C is locally precipitated at a grain boundary to enhance the strength of the grain boundary and partially forms a carbide (e.g., TiC and TaC) to precipitate in the aggregated form. In order that C is locally precipitated at the grain boundary to enhance the strength of the grain boundary, it is necessary that 0.05% by mass or more of C be added. However, when more than 0.20% by mass of C is added, an excess carbide is formed to lower ductility and creep strength at high temperatures and also to lower corrosion resistance, and thus it is necessary that the upper limit of the content of C be 0.20% by mass. In view of a balance among strength, ductility and corrosion resistance in the composition range, the content of C is in the range of preferably 0.10 to 0.18% by mass, more preferably 0.12 to 0.17% by mass.

B: 0.005 to 0.02% by Mass

B is locally precipitated at a grain boundary to enhance the strength of the grain boundary and partially forms a boride [$(Cr, Ni, Ti, Mo)_3B_2$] to precipitate at a grain boundary of the superalloy. In order that B is locally precipitated at the grain boundary to enhance the strength of the grain boundary, it is necessary that 0.005% by mass or more of B be added. However, the boride has a melting point lower than that of the superalloy and thus remarkably lowers the fusion temperature of the superalloy and makes a solution heat treatment difficult, and thus it is desirable that the upper limit of the content of B be 0.02% by mass. In view of a balance among strength and solution heat treatment properties in the composition range, the content of B is in the range of preferably 0.01 to 0.02% by mass.

Hf: 0 to 2.00% by Mass; Re: 0 to 0.50% by Mass; Zr: 0 to 0.05% by Mass

Hf, Re and Zr are locally precipitated at a grain boundary to somewhat enhance the strength of the grain boundary. However, major parts thereof form, at the grain boundary, an intermetallic compound with nickel, i.e., $Ni_3Zr$ and the like. The intermetallic compound lowers a ductility of the superalloy, a fusion temperature of the superalloy is lowered due to a low melting point to narrow a solution treatment temperature range of the superalloy and the like, and thus effective actions are small. Therefore, the upper limits thereof are 2.00% by mass, 0.50% by mass, and 0.05% by mass, respectively. Preferably, the content of Hf is 0 to 0.10% by mass, the content of Re is 0 to 0.10% by mass, and the content of Zr is 0 to 0.03% by mass.

O: 0 to 0.005% by Mass; N: 0 to 0.005% by Mass

Oxygen and nitrogen are impurities, in many cases they are incorporated from raw materials for superalloy, O is also incorporated from a crucible, and they are present as an oxide ($Al_2O_3$) or a nitride (TiN or AlN) in the aggregated form in the superalloy. When they are present in castings, they become a starting point of a crack during a creep deformation to lower a creep rupture life or become a starting point of a fatigue crack generation to lower a fatigue life. Especially, the oxygen appears as an oxide in a surface of the castings, and thus to result in a surface defect of the castings and a cause for lowering a yield of a cast product. Therefore, smaller contents of oxygen and nitrogen are better, but oxygen-free or nitrogen-free conditions cannot be achieved in the actual production of an ingot, and thus it is desirable that the contents of both elements be 0.005% by mass or less as ranges which do not remarkably deteriorate the characteristics.

The Ni-based superalloy comprising the above respective components and inevitable impurities and the balance being Ni is a superalloy having an improved balance among high temperature strength, corrosion resistance characteristics and oxidation resistance characteristics.

EXAMPLES

Ni-based superalloys subjected to tests in the present Examples are shown below. Compositions (% by mass) of the Ni-based superalloys are shown in Table 1. Each of test specimens was prepared by dissolving a master ingot and alloying elements weighed in an alumina crucible to cast into a flat plate having a thickness of 14 mm. A casting mold heating temperature was 1373 K, a casting temperature was 1713 K, and an alumina ceramics casting mold was used as the casting mold. After casting, each of the test specimens was subjected to a solution heat treatment and an aging heat treatment as shown in Table 2. In order to uniformize the superalloy compositions, the solution heat treatment was conducted at 1480 K for 2 hours. After the solution heat treatment, they were air-cooled, and the conditions of the sequential aging heat treatment of all of the superalloys were 1366 K/4 hours/air-cooling+1340 K/4 hours/air-cooling+1116 K/16 hours/air-cooling. Then, processing of test specimens was conducted, and creep rupture tests, corrosion tests, oxidation tests and tension tests were conducted.

Creep test specimens having a parallel body diameter of 6.0 mm and a parallel body length of 30 mm, high temperature oxidation test specimens having a length of 25 mm and a width of 10 mm and a thickness of 1.5 mm, and high temperature corrosion test specimens in the cubic form having a size of 15 mm×15 mm×15 mm were cut away by machine works from heat treated test specimens, and further microstructures were investigated by a scanning electron microscope to evaluate structure stabilities of the superalloys.

Table 3 shows conditions of characteristic evaluation tests conducted on the superalloy test specimens. The creep rupture test was conducted under the conditions of 1123 K and 314 MPa. The high temperature oxidation test was conducted by repeating an oxidation test retained at 1373 K for 20 hours 10 times and measuring a change in mass. The high temperature corrosion test was conducted by repeating a test of immersing in a molten salt (a composition is $Na_2SO_4$: 75% and NaCl: 25%) of 1123 K for 25 hours 4 times (100 hours in total) and measuring a change in mass.

TABLE 1

| Item | Superalloy number | Cr | Co | Ti | Al | Mo | W | Ta | Nb | Hf | Re | P | Zr | S | C | B | O | N | Ni |
|---|---|---|---|---|---|---|---|---|---|---|---|---|---|---|---|---|---|---|---|
| Examples | A1 | 13.81 | 13.1 | 4.85 | 3.12 | 1.02 | 5.02 | 3.02 | 0.81 | 0.04 | 0.003 | 0.002 | 0.01 | 0.003 | 0.165 | 0.015 | 0.001 | 0.002 | 55.009 |
| | A2 | 13.74 | 14.0 | 4.92 | 3.25 | 0.95 | 4.63 | 3.1 | 0.45 | 0.02 | 0.004 | 0.001 | 0.02 | 0.001 | 0.158 | 0.015 | 0.001 | 0.001 | 54.739 |
| | A3 | 13.82 | 16.59 | 4.95 | 3.09 | 0.92 | 4.61 | 2.92 | 0.36 | 0.03 | 0.007 | 0.002 | 0.01 | 0.005 | 0.162 | 0.015 | 0.002 | 0.001 | 52.506 |
| | A4 | 13.95 | 17.79 | 5.01 | 3.15 | 0.89 | 4.75 | 3.15 | 0.35 | 0.04 | 0.004 | 0.004 | 0.02 | 0.001 | 0.134 | 0.015 | 0.001 | 0.002 | 50.74 |
| | A5 | 13.68 | 16.25 | 4.89 | 2.89 | 0.96 | 4.69 | 2.98 | 0.41 | 0.01 | 0.009 | 0.003 | 0.03 | 0.003 | 0.154 | 0.015 | 0.001 | 0.001 | 53.023 |
| Conventional superalloys | B1 | 14.01 | 9.52 | 4.85 | 3.07 | 4.13 | 4.14 | 0 | 0 | 0 | 0.005 | 0.004 | 0.04 | 0.002 | 0.17 | 0.015 | 0.001 | 0.003 | 60.04 |
| | B2 | 15.96 | 8.36 | 4.79 | 3.32 | 1.76 | 2.63 | 1.74 | 0.87 | 0.03 | 0.006 | 0.003 | 0.01 | 0.005 | 0.11 | 0.01 | 0.002 | 0.002 | 60.392 |

TABLE 2

| Item | Superalloy number | Solution treatment condition | Aging condition: First stage aging | Aging condition: Second stage aging | Aging condition: Third stage aging |
|---|---|---|---|---|---|
| Example | A1-A5 | 1480K/2 h AC | 1366K/4 h AC | 1340K/4 h AC | 1116K/16 h AC |
| Conventional superalloys | B1 | 1480K/2 h AC | 1366K/4 h AC | 1325K/4 h AC | 1116K/16 h AC |
| | B2 | — | 1395K/2 h AC | 1116K/24 h AC | — |

TABLE 3

| Evaluation test | Test content |
|---|---|
| Creep rupture test | Test temperature and stress 1123K-314 MPa |
| Oxidation test | Oxidation test repeated in a atmospheric air for 20 hours 1373K-200 h |
| Corrosion test | Immersion test in molten salt of 1123K $NaSO_4$(75%) + NaCl(25%) 25 hours × 4 times |

Figure 1:
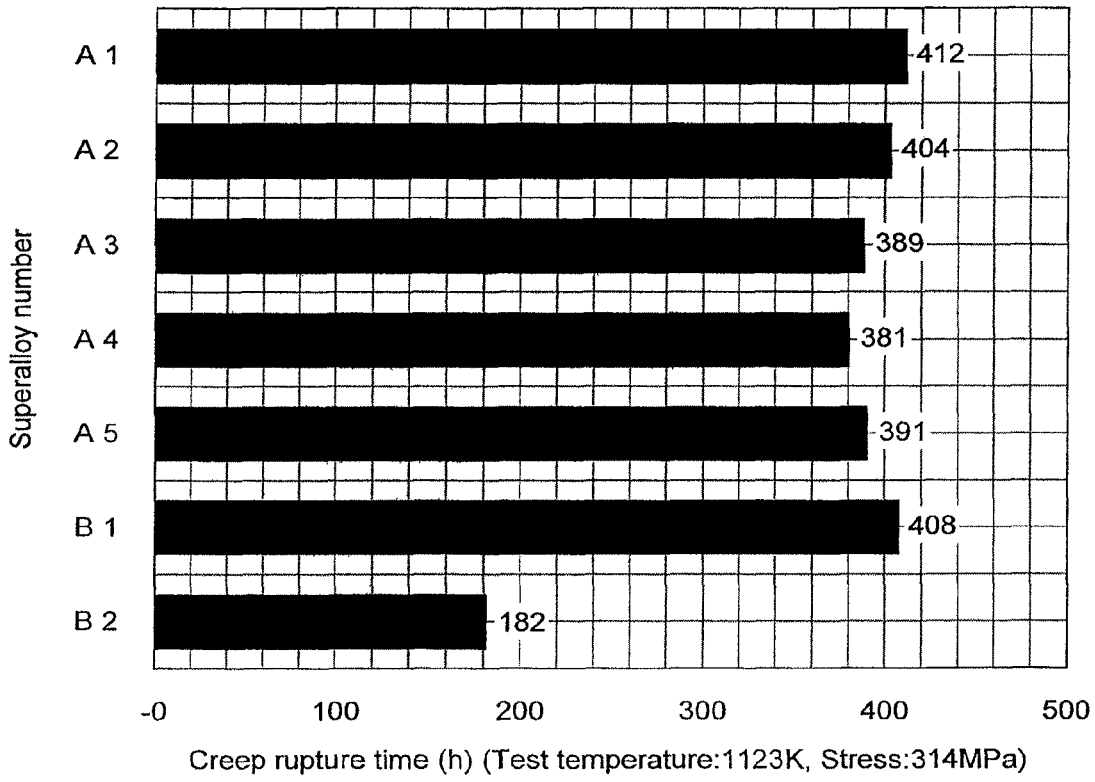
FIG. 1 is a graph showing a creep rupture time of each of superalloy test specimens.
Figure 2:
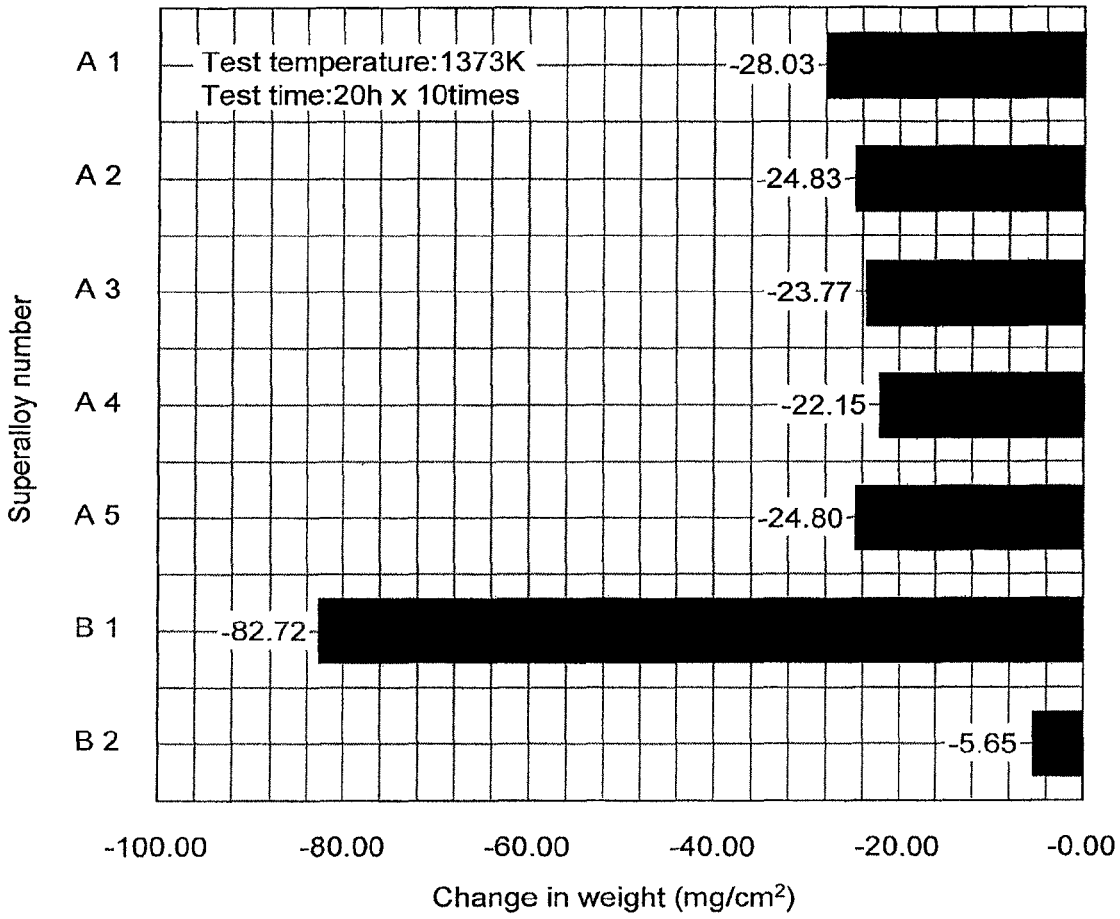
FIG. 2 is a graph showing an oxidation loss in weight of each of superalloy test specimens in a high temperature oxidation test.
Figure 3:
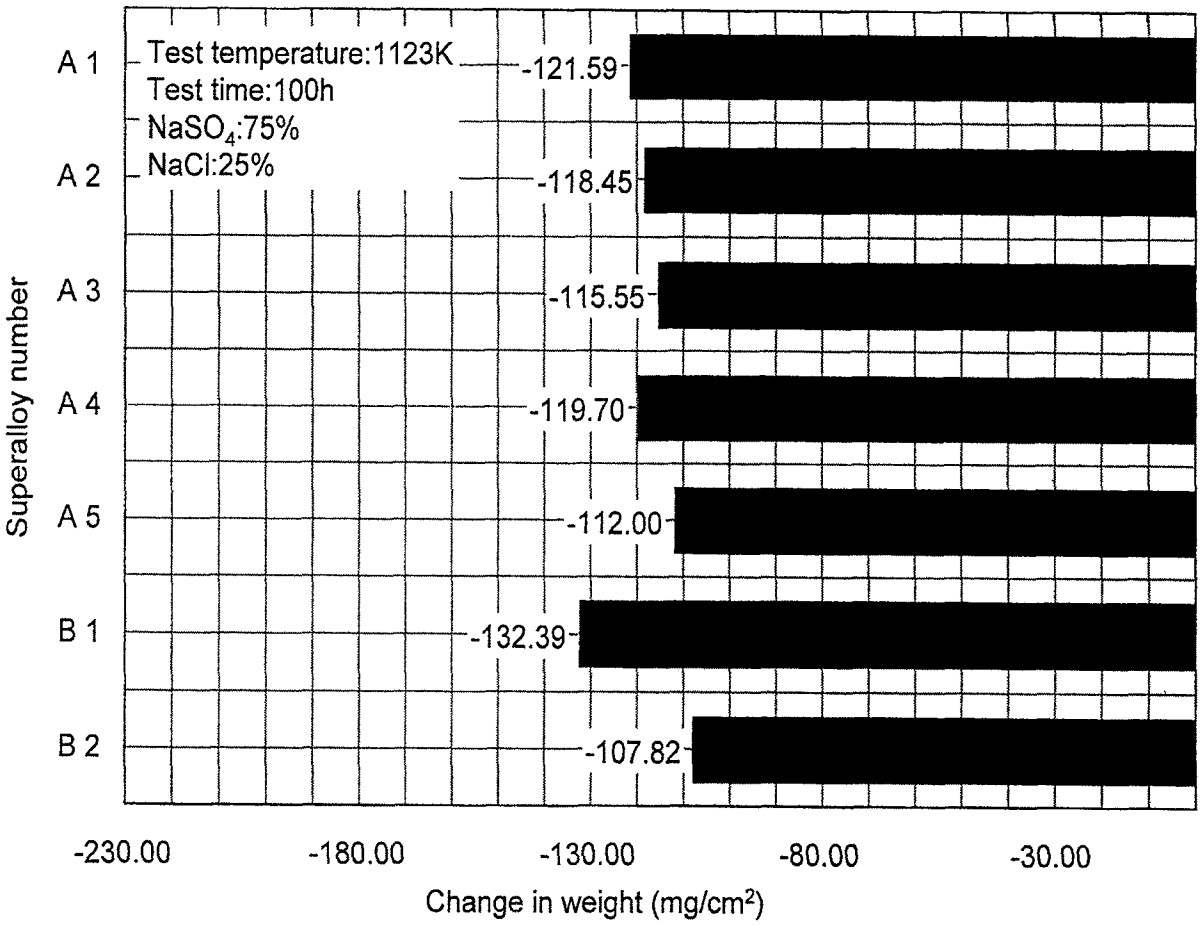
FIG. 3 is a graph showing a corrosion loss in weight of each of superalloy test specimens in a molten salt immersion corrosion test.

Table 4, FIG. 1, FIG. 2 and FIG. 3 show results of characteristics evaluation tests of respective superalloys. Table 4 is a list of the results, FIG. 1 is a graph showing measured results of a creep rupture time at 1123 K and 314 MPa, FIG. 2 is a graph showing measured results of an oxidation loss in weight in a high temperature oxidation test, and FIG. 3 is a graph showing measured results of a corrosion loss in weight in a molten salt immersion corrosion test.

TABLE 4

| Item | Superalloy number | Creep rupture time 1123K-314 MPa(h) | Amount of oxidation ($mg/cm^2$) | Amount of corrosion ($mg/cm^2$) |
|---|---|---|---|---|
| Examples | A1 | 412 | −28.03 | −121.59 |
| | A2 | 404 | −24.83 | −118.45 |
| | A3 | 389 | −23.77 | −115.55 |
| | A4 | 381 | −22.15 | −119.70 |
| | A5 | 391 | −24.80 | −112.00 |
| Conventional superalloys | B1 | 408 | −82.72 | −132.39 |
| | B2 | 182 | −5.65 | −107.82 |

As clear from the results shown in Table 4, it is found that each of superalloys of A1 to A5 of the present Examples has almost the same creep rupture strength, a remarkably improved oxidation loss in weight, and an improved corrosion resistance, as compared to a conventional superalloy B1 (Rene80). Especially, an enhancement of oxidation resistance is remarkable. In the superalloys of the present Examples, an enhancement of oxidation resistance is tried with decreasing the amount of Mo to a large degree, as compared to the conventional material B1. As compared to another conventional superalloy B2 (IN738LC), oxidation resistance and corrosion resistance are somewhat lowered, but creep rupture time is lengthened about twice or more. In the superalloys of the present Examples, an enhancement of creep strength at high temperatures is tried with increasing amounts of W and Ta added, as compared to B2.

That is, according to the present invention, it was recognized that oxidation resistance characteristics and corrosion resistance at high temperatures can be remarkably enhanced with hardly scarifying a creep rupture life, and that a superalloy having a good balance among creep strength, oxidation resistance characteristics and corrosion resistance can be obtained.

In the above Examples, effects as conventional casting materials were described. Additionally, it is also very effective to use the superalloys of the present invention as a directionally solidified bucket which is directionally solidified. It is a well-known fact that a creep rupture strength can be enhanced to a large degree with maintaining corrosion resistance and oxidation resistance characteristics by directionally solidifying. Especially, the superalloy of the present invention contains C and B, which are effective for reinforcement of a grain boundary, and Hf, which is effective for inhibition of grain boundary cracking during casting, can be further added according to need, and thus the superalloy of the present invention has a superalloy composition suitable for use as a directionally solidifying material.

As mentioned above, according to the present invention, a Ni-based superalloy, which can be subjected to a conventional casting, having both a good high-temperature creep strength and corrosion resistance and oxidation resistance can be obtained. Therefore, the superalloy is suitable for forming turbine rotor and stator blades of an industrial gas turbine.

Meanwhile, the present invention is not limited to Examples mentioned above and includes several kinds of variation examples. For example, a part of constitutions of a certain Example can be substituted with a constitution of another Example, and further a constitution of another Example can be added to a constitution of a certain Example, and in respect to a part of constitutions of each Example, another constitution can be added, deleted or substituted.

DESCRIPTION OF SYMBOLS

1 Turbine rotor blade
10 Blade part
11 Shank part
12 Root part (dovetail part)
13 Platform part
14 Radial fin

What is claimed is:

1. A Ni-based superalloy comprising Cr, Co, Al, Ti, Ta, W, Mo, Nb, C, B, O, N, and inevitable impurities, the balance being Ni, the Ni-based superalloy having a superalloy composition comprising, by mass, 13.1 to 14.3% of Cr, 13.1 to 18.0% of Co, 2.60 to 3.30% of Al, 4.65 to 5.50% of Ti, 2.70 to 3.30% of Ta, 4.55 to 4.90% of W, 0.10 to 1.10% of Mo, 0.10 to 0.65% of Nb, 0.10 to 0.18% of C, 0.01 to 0.02% of B, 0.001 to 0.005% of 0, and 0.001 to 0.055% of N.

2. The Ni-based superalloy according to claim 1, wherein the Ni-based superalloy has a superalloy composition comprising, by mass, 13.7 to 14.1% of Cr, 14.1 to 17.0% of Co, 3.00 to 3.20% of Al, 4.70 to 5.10% of Ti, 2.90 to 3.20% of Ta, 4.55 to 4.85% of W, 0.70 to 1.00% of Mo, 0.25 to 0.45% of Nb, and 0.12 to 0.17% of C.

3. A cast product comprising a Ni-based superalloy according to claim 1.

4. A turbine rotor blade for a gas turbine comprising a Ni-based superalloy according to claim 1.

5. A turbine stator blade for a gas turbine comprising a Ni-based superalloy according to claim 1.

6. A Ni-based superalloy comprising Cr, Co, Al, Ti, Ta, W, Mo, Nb, C, B, O, N, Hf, Re, Zr, P, S, and inevitable impurities, the balance being Ni, the Ni-based superalloy having a superalloy composition comprising, by mass, 13.1 to 16.0% of Cr, 11.1 to 20.0% of Co, 2.30 to 3.30% of Al, 4.55 to 6.00% of Ti, 2.50 to 3.50% of Ta, 4.00 to 5.50% of W, 0.10 to 1.20% of Mo, 0.10 to 0.90% of Nb, 0.05 to 0.20% of C, 0.005 to 0.02% of B, 0.001 to 0.005% of 0, 0.001 to 0.055% of N, 0.01 to 2.00% of Hf, 0.003 to 0.50% of Re, 0.01 to 0.05% Zr, 0.001 to 0.004% of P, and 0.001 to 0.005% of S.

7. The Ni-based superalloy according to claim 6, wherein the Ni-based superalloy has a superalloy composition comprising, by mass, 0.01 to 0.04% of Hf.

8. The Ni-based superalloy according to claim 7, wherein the Ni-based superalloy has a superalloy composition comprising, by mass, 0.003 to 0.10% Re, and 0.01 to 0.03% Zr.

9. A cast product comprising a Ni-based superalloy according to claim 6.

10. A turbine rotor blade for a gas turbine comprising a Ni-based superalloy according to claim 6.

11. A turbine stator blade for a gas turbine comprising a Ni-based superalloy according to claim 6.

12. A turbine rotor blade for a gas turbine comprising a Ni-based superalloy comprising Cr, Co, Al, Ti, Ta, W, Mo, Nb, C, B, O, N, Hf, Re, Zr, P, S, and inevitable impurities, the balance being Ni, the Ni-based superalloy having a superalloy composition comprising, by mass, 13.1 to 16.0% of Cr, 11.1 to 20.0% of Co, 2.30 to 3.30% of Al, 4.55 to 6.00% of Ti, 2.50 to 3.50% of Ta, 4.00 to 5.50% of W, 0.10 to 1.20% of Mo, 0.10 to 0.90% of Nb, 0.05 to 0.20% of C, 0.005 to 0.02% of B, 0.001 to 0.005% of 0, 0.001 to 0.005% of N, 0.01 to 2.00% of Hf, 0 to 0.50% of Re, 0.01 to 0.05% Zr, 0.001 to 0.004% of P, and 0.001 to 0.005% of S.

13. A turbine stator blade for a gas turbine comprising a Ni-based superalloy comprising Cr, Co, Al, Ti, Ta, W, Mo, Nb, C, B, O, N, Hf, Re, Zr, P, S, and inevitable impurities, the balance being Ni, the Ni-based superalloy having a superalloy composition comprising, by mass, 13.1 to 16.0% of Cr, 11.1 to 20.0% of Co, 2.30 to 3.30% of Al, 4.55 to 6.00% of Ti, 2.50 to 3.50% of Ta, 4.00 to 5.50% of W, 0.10 to 1.20% of Mo, 0.10 to 0.90% of Nb, 0.05 to 0.20% of C, 0.005 to 0.02% of B, 0.001 to 0.005% of 0, 0.001 to 0.005% of N, 0.01 to 2.00% of Hf, 0 to 0.50% of Re, 0.01 to 0.05% Zr, 0.001 to 0.004% of P, and 0.001 to 0.005% of S.

* * * * *